United States Patent [19]

Netti

[11] 4,330,120

[45] May 18, 1982

[54] RUNNING OR JOGGING EXERCISING GLOVE

[76] Inventor: James Netti, 9 Frances St., Auburn, N.Y. 13021

[21] Appl. No.: 197,556

[22] Filed: Oct. 16, 1980

[51] Int. Cl.[3] ..... A63B 21/12

[52] U.S. Cl. ..... 272/119; 272/67; 273/DIG. 24; 273/DIG. 30

[58] Field of Search ..... 272/119, 67, 68, 93, 272/117, 70; 2/161 A, 159, 16, 20, 160

[56] References Cited

U.S. PATENT DOCUMENTS

| | | | |
|---|---|---|---|
| 2,154,197 | 4/1939 | Callaway | 2/159 |
| 3,149,839 | 9/1964 | Materia | 272/119 X |
| 4,034,979 | 7/1977 | Wester | 272/119 X |
| 4,247,097 | 1/1981 | Schwartz | 272/119 |

*Primary Examiner*—Richard C. Pinkham
*Assistant Examiner*—William R. Browne
*Attorney, Agent, or Firm*—Bruns & Jenney

[57] ABSTRACT

An exercise device for conditioning the upper arms and body muscles. Said device includes a glove having a hand section, a wrist section and a forearm section, said glove encompassing the entire forearm region of the wearer. The hand section and the forearm section of the glove contains strategically positioned weights that are arranged to enhance development and toning of the arm and upper body muscles when the arm is moved through a normal swinging motion, as for example, when the wearer is running or jogging.

10 Claims, 3 Drawing Figures

RUNNING OR JOGGING EXERCISING GLOVE

BACKGROUND OF THE INVENTION

This invention relates to apparatus for developing and toning arm and upper body muscles and, in particular, to a glove that can be conveniently worn when exercising which aids in the development of certain upper body and arm muscles.

More specifically this invention relates to a glove containing strategically positioned weights which serve to develop and tone muscles in both the arm and the upper body of a wearer when the arm is moved rhythmically through a natural swinging cycle, as for example, when the wearer is running or jogging.

Weighted gloves have been used in different types of athletic activities to improve balance or body positioning and to provide added impetus to the arm when striking a ball, flycasting or the like.

In U.S. Pat. Nos. 4,034,979 and 3,149,839, weighted hand gloves are disclosed which are specifically designed as counterbalancing devices for offsetting the weight of a bowling ball. The gloves are worn by the bowler upon his or her non-throwing hand. The glove weights offset the weight of the ball and thus help the bowler maintain a well balanced posture during delivery so that he or she might be better able to score more effectively. The weights in this type of glove are all situated about the hand and the amount of weight required to offset the weight of the ball is typically high. Wearing this type of hand glove during an exercise program of any duration would in all probability cause rapid fatigue and, rather than helping to develop and tone muscles, might cause muscle damage.

Weighted gloves for use by golfers or fishermen are disclosed in the following U.S. Pat. Nos.:

889,397
2,011,362
2,154,197
3,124,806.

Here again, the disclosed gloves only cover the hand and/or wrist of the wearer. The weights are situated along the back of the hand so that the wearer is able to grasp an instrument, such as a bat, club, racket or rod. The weights are added primarily to increase wrist action or to enable the wearer to deliver a more effective blow when striking a ball. The weights are not positioned where they might help in muscle conditioning and, as in the case of the bowler's gloves, would probably cause problems if used in an exercise program.

The glove embodying the teachings of the present invention is ideally suited for use by runners and joggers who swing their arms naturally from side to side as they move along. Although running and jogging is an extremely beneficial form of exercise, it does not help condition certain upper body and arm muscles. The instant glove contains a series of weights that are positioned about the hand and the forearm of the wearer so as to take full advantage of the natural motion of the arm to tone and condition certain muscles without producing undue fatigue. The glove also serves a very useful secondary function in helping the wearer fend off unfriendly animals and humans who have been known to attack runners and joggers. A well directed arm blow by one wearing the present glove can deter this type of attacker. Some joggers carry heavy sticks or metal bars for protection. However, these weapons are clumsy and impede the pumping action of the arms which is so essential for establishing a good rhythm.

SUMMARY OF THE INVENTION

An object of the present invention is to improve exercise techniques used for toning and developing muscles of the arms and the upper part of the body.

A further object of the present invention is to provide a glove that has strategically positioned weights connected thereto which help develop and tone muscles when the arm is moved through a natural swinging cycle.

A still further object of this invention is to provide a weighted glove that can be worn by a jogger or a runner which will help develop muscles not ordinarily conditioned by this form of exercise.

Another object of this invention is to provide a glove that contains weights covering the hand and the forearm of the user which help to condition certain muscles when the arm is moved as in jogging.

Yet another object of the present invention is to provide an exercise glove that when worn by a jogger makes the wearer highly visible during daylight or evening hours.

A still further object of the present invention is to provide an exercise glove for a jogger that can also be used as a protective device in the event the wearer is attacked by unfriendly animals or humans.

These and other objects of the invention are attained by means of an exercise glove that covers the hand and the forearm of the wearer and has strategically positioned replaceable weights attached thereto which serve to tone and develop arm and upper body muscles as the arm is swung through a normal motion as when running or jogging. One set of weights are positioned about the hand while another set extends along the top of the wearer's forearm. The second set of weights are carried in special pockets built into the glove and are further secured to the arm by a pair of straps that prevent the weights from shifting or otherwise being displaced as the arm is moved through a swinging motion.

BRIEF DESCRIPTION OF THE DRAWINGS

For a better understanding of these and other objects and further features of the invention, reference is had to the following detailed description of the invention which is to be read in conjunction with the accompanying drawings, wherein.

DESCRIPTION OF THE INVENTION

Figure 1:
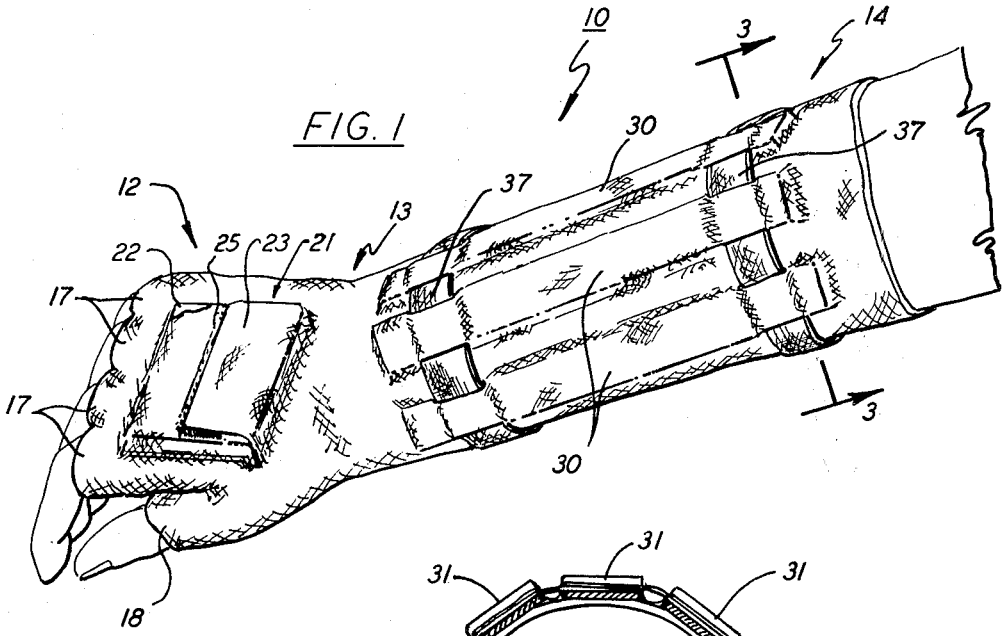
FIG. 1 is a perspective view showing the back of the hand and the posterior region of the forearm of a person wearing an exercise glove embodying the teachings of the present invention.

As previously noted, the exercise glove of the instant invention is ideally well suited for use by a jogger or a runner who, in addition to gaining the benefits afforded by this form of exercise also wishes to tone and develop other muscles in the upper part of the body and arms. These muscles include, but are not necessarily limited to, the biceps, triceps, brachioradialis, deltoid, trapezius and pectoralis major. Generally, activities involving the lifting of weights are used to condition these muscles. As will be explained in further detail below, the weighted glove of the present invention is employed to convert the normal pumping action of a runner's arms into the same type of muscle conditioning exercise as experienced when lifting weights whereby running or jogging can provide additional benefits.

Turning now to the drawings, the present glove that embodies the teachings of the present invention, which is generally referenced 10, is shown being worn upon the right arm of the user. It should be understood, however, that gloves are made in pairs and ordinarily, when exercising, will be worn on both hands. Although the present invention will be explained in regard to the right hand glove shown, it should be clear that the left hand glove is of similar construction and functions in the same manner to condition muscles on the other side of the body. The glove contains three sections that will be referred to herein as the hand section 12, the wrist section 13 and forearm section 14. The sections are all woven or otherwise formed into a single piece of material which substantially encloses the referenced part of the arm. The glove may be constructed of any suitable pliable and porous material that will permit air to circulate therethrough. Such materials as Naugahyde, canvass and some types of open weaved nylons can be used in fabricating the instant glove.

The underside or anterior region of the forearm section of the glove is provided with a longitudinally extended closure mechanism which permits the glove to be easily passed over the arm when the closure mechanism is opened and to snuggly enclose the arm when it is closed. Preferably the closure mechanism is a heavy duty, lightweight zipper 15 which extends from the wrist section to the distal edge 16 of the forearm section.

The hand section of the glove contains truncated finger holes 17—17 and a truncated thumb hole 18 that allow the digets on the wearer's hand to pass therethrough. The hand section further includes two pockets 20 and 21 that are adapted to enclose weights therein. Pocket 20 is sewed into the palm of the glove and encloses a cylindrical shaped weight about which the hand of the wearer can be cupped. Pocket 21 is arranged to cover the metacarpal region on the back of the hand. The pocket is generally rectangular in form and is provided with a flap 23 by which the pocket can be opened or closed. The flap includes a Velcro-type fastener 25 positioned along the bottom edge. The Velcro-type fastener includes a pad sewed to the inside surface of the flap with fiber hooks that are adapted to engage fiber loops on an opposed pad sewed to the top surface of the pocket. Pressing the pads together secures the flap in a closed position. A removable weight 22 is contained within the pocket. By changing weights, the amount of weight carried in the pocket may be altered. Preferably, the amount of weight carried in the metacarpal pocket 21 should be about equal to the amount of weight carried in the palm pocket 20. This arrangement provides for a well balanced combination that minimizes arm fatigue when the arm is swung in a normal rhythm.

Figure 3:
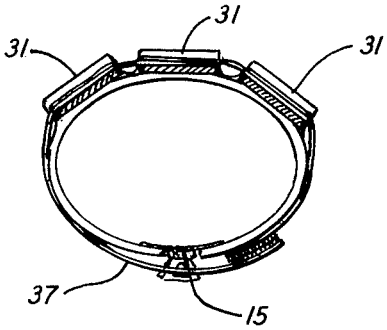
FIG. 3 is an end view in partial section of the exercise glove shown in FIGS. 1 and 2 further illustrating the positioning of the weights located in the forearm section of the glove.

The forearm section of the glove contains a plurality of longitudinally extended pockets 30—30 positioned along the posterior thereof. Pockets 30—30 are fabricated of a stretch fabric that is sewed or otherwise joined to the glove to provide an expandable chamber in which stepped weights 31—31 (FIG. 3) are inserted. At least one end of each pocket is open so that the weights can be slidably received within the pockets. Once positioned in the pocket the stretch material conforms to the contour of the enclosed weight thereby holding the weight tightly to the glove. In practice, the forearm weights each contain a raised midsection and two end sections of lesser height, the purpose of which will become apparent from the disclosure below.

A pair of straps 37—37 are adapted to pass circumferentially around the forearm section of the glove. One end 40 of each strap is secured to the forearm section of the glove adjacent to the zipper seam. Each strap is slidably passed through one end of each longitudinally extended forearm pocket. A two part Velcro fastener is provided for each strap. A loop pad 42, which is contained on top of the strap end joined to the glove adjacent to the zipper, coacts with a hook pad 43 secured to the bottom surface of the opposite strap end.

Figure 2:
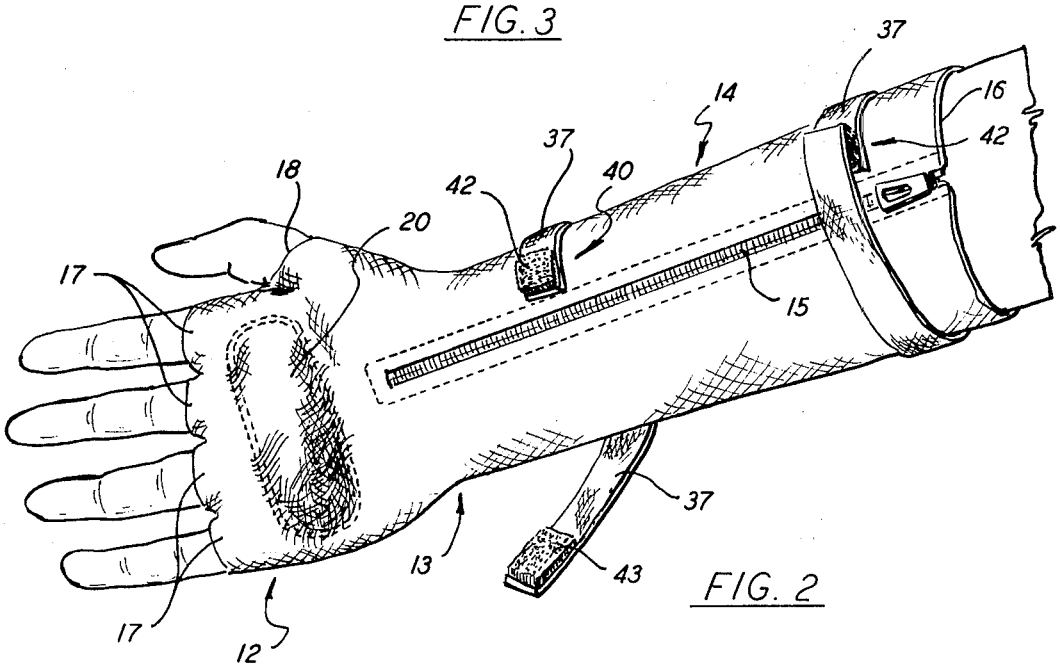
FIG. 2 is also a perspective view showing the palm and the anterior region of the forearm of a person wearing the exercise glove shown in FIG. 1.

The width of each strap is slightly less than the axial length of the reduced end section of the forearm weights. In assembly, the straps pass over the reduced end sections so that when fastened in a closed position about the arm, serve to both hold the weight tightly against the posterior part of the forearm and to prevent them from moving laterally along the arm. The straps are adapted to pass over the zipper as illustrated in FIG. 2.

The combined weight of the forearm weights is preferably equalto about three times the total combined weight of the palm and metacarpal weights contained in the hand section of the glove. It is believed that the three to one ratio provides the most effective combination available for conditioning the upper arm and body muscles. The total weight of the forearm weights should also be distributed evenly over the posterior forearm. The length of the weights should extend from the wrist to a point about five or six inches above the wrist section. Although three forearm weights are herein disclosed, it should also be evident that the number may be varied without departing from the teachings of the present invention.

As can be seen, the weighted glove of the present invention is capable of securely holding the weights to the wearer's arm without impeding the ability of the arm to swing through a normal cycle. In addition, the glove will provide the wearer with a good deal of protection against unfriendly animals and humans. Because of the weight, and the positioning of the weights, the wearer can deliver a heavy blow against an attacker. By the same token, the weights positioned along the posterior forearm region can also be used defensively for fending off blows and, in the case of animals, by rendering bites ineffective. It is further envisioned that the glove will be made from various colored materials that will be highly visible during daylight hours and highly reflective to light at night. Alternatively, reflective luminescent stripes of reflective materials can be attached to the forearm of the glove.

It should be further noted that the present glove may be used as a means of developing wrist strength by the wearer opening and closing the hand about the palm weight as he is going through his exercise program. Similarly, the wrist may be rotated back and forth to further develop wrist strength which will bring into play both the palm and the metacarpal weights.

While this invention has been described with reference to the details as set forth above, it is not limited to the specific structure as disclosed and the invention is intended to cover any modifications or changes as may come within the scope of the following claims.

I claim:

1. A device for conditioning upper arms and body muscles while running or jogging, wherein said device for each arm includes a glove having a hand section, a wrist section and a forearm section which encompasses the entire forearm region of the wearer, said sections being formed of a pliable material, a first weight means attached to the palm region of the hand section, a second weight means attached to the metacarpal region of the hand section and a third weight means including a plurality of weights attached to the posterior region of the forearm section that extend longitudinally substantially along the entire length of the forearm section, retaining means connected to the forearm section for securing the said third weight means to the posterior region of the wearer's forearm, and said first and second weight means being of substantially the same weight to permit the arms to swing freely while the wearer is running.

2. The device of claim 1 wherein said retaining means includes at least one strap capable of being wrapped about the forearm section, and fastener means associated with the strap for adjustably securing the ends of the strap.

3. The device of claim 1 that further includes attaching means for said second and third weight means that comprises first and second weight receiving pockets for slidably receiving the weights therein.

4. The device of claim 1 wherein the combined weight of said third weight means is substantially equal to three times the combined amount of weight of said first and second weight means.

5. A device for conditioning upper arms and body muscles while running or jogging, wherein said device for each arm includes a glove having a hand section, a wrist section and a forearm section which encompasses the entire forearm region of the wearer, said sections being formed of a pliable material, a first weight means attached to the palm region of the hand section, a second weight means attached to the metacarpal region of the hand section, said third weight means including a plurality of weights attached to the posterior region of the forearm section, said plurality of weights being evenly distributed over the posterior region, a closure means located in the anterior region of the forearm section that extends from the wrist section to the distal edge of the forearm section to permit the forearm section to be opened and closed, a pair of straps for securing said third weight means to the arms of the wearer, each strap being secured to the forearm section adjacent to one side of the closure means and having a fastening means being secured to the forearm section adjacent to the same side of the closure means as said one end of each strap whereby the opposite end of said strap can be wrapped about the arm of the wearer and secured over the closure means and said first and second weight means being of substantially the same weight to permit the arms of the wearer to swing freely.

6. The device of claim 5 wherein the fastening means includes a Velcro fastener having a loop pad secured to one end of each strap and a hook pad secured to the other end of each strap.

7. The device of claim 6 wherein said closure means includes a zipper extending longitudinally along the anterior region of the forearm section.

8. The device of claim 7 wherein said second and third weight means are attached to the glove by openable pockets.

9. The device of claim 8 wherein said straps are each slidably connected with the pockets for attaching said third weight means to said glove.

10. The device of claim 5 wherein the combined weight of said third weight means is substantially equal to three times the combined weight of said first and second weight means.

* * * * *